US006914495B2

(12) United States Patent
Kocharyan

(10) Patent No.: US 6,914,495 B2
(45) **Date of Patent: *Jul. 5, 2005**

(54) SURFACE MOUNTABLE CIRCULATOR/ ISOLATOR AND ASSEMBLY TECHNIQUE

(75) Inventor: Karen N. Kocharyan, Somerville, MA (US)

(73) Assignee: Renaissance Electronics Corporation, Harvard, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/911,275

(22) Filed: Aug. 4, 2004

(65) Prior Publication Data

US 2005/0007206 A1 Jan. 13, 2005

Related U.S. Application Data

(63) Continuation of application No. 10/314,745, filed on Dec. 9, 2002, now Pat. No. 6,850,126, which is a continuation-in-part of application No. 10/005,520, filed on Dec. 7, 2001, now Pat. No. 6,504,445.

(51) Int. Cl.[7] ..... H01P 1/32
(52) U.S. Cl. ..... 333/1.1; 333/24.2
(58) Field of Search ..... 333/1.1, 24.2; 174/52.5; 361/783; 257/704, 726

(56) References Cited

U.S. PATENT DOCUMENTS

| | | | | |
|---|---|---|---|---|
| 3,621,476 | A | 11/1971 | Kanbayashi | |
| 3,673,518 | A | 6/1972 | Carr | |
| 3,873,757 | A | 3/1975 | Berke et al. | |
| 5,164,687 | A | 11/1992 | Kurian et al. | |
| 5,185,587 | A | 2/1993 | Kurian et al. | |
| 6,011,449 | A | 1/2000 | Jussaume et al. | |
| 6,130,587 | A | 10/2000 | Jun et al. | |
| 6,218,611 | B1 | 4/2001 | Bias | |
| 6,337,607 | B1 | 1/2002 | Genfan | |
| 6,359,792 | B1 | 3/2002 | Genfan | |
| 6,429,758 | B1 | 8/2002 | Emelo et al. | |
| 6,563,394 | B1 | 5/2003 | Kudo | |
| 6,850,126 | B2 * | 2/2005 | Kocharyan | 333/1.1 |

* cited by examiner

*Primary Examiner*—Stephen E. Jones
(74) *Attorney, Agent, or Firm*—Maine & Asmus

(57) ABSTRACT

A structure for a passive microwave device capable of low IMD and high power operation, and adapted for automated assembling and placement is disclosed. The device exhibits a high degree of coplanarity on its mounting surface, as well as a high degree of flatness and alignment between its respective components. The inherent self-aligning qualities of the design are used in conjunction with an assembly fixture that has three or more alignment pins to provide a highly manufacturable and reliable device. Related manufacturing methods and fixturing are also disclosed.

25 Claims, 7 Drawing Sheets

SURFACE MOUNTABLE CIRCULATOR/ ISOLATOR AND ASSEMBLY TECHNIQUE

RELATED APPLICATIONS

This application is a continuation of U.S. application Ser. No. 10/314,745, filed Dec. 9, 2002, now U.S. Pat. No. 6,850,126, which is a continuation-in-part of U.S. application Ser. No. 10/005,520, filed Dec. 7, 2001, now U.S. Pat. No. 6,504,445. Each of these applications is herein incorporated in its entirety by reference.

FIELD OF THE INVENTION

The invention relates to microwave ferrite devices, and more particularly, to a surface mountable circulator/isolator design and assembly technique.

BACKGROUND OF THE INVENTION

Increasing demands for high signal power and bandwidth capacity in modem communication networks impose stronger limitations on the allowed level of intermodulation distortion (IMD). A typical level of IMD is about −75 dBc for existing high power circulators, which is not sufficient for providing the desired degree of inter-channel isolation. The suppression of IMD decreases the interference between the adjacent communication channels and leads to the higher quality of operation. Therefore, the development of a circulator/isolator that is capable of handling high input power while maintaining a low IMD would be highly desirable.

A major contributor to IMD in microwave ferrite devices, such as circulators/isolators, is the non-linear phenomenon of ferromagnetic resonance. The closer the frequency of ferromagnetic resonance (FMR) is to the operating frequency range, the larger is the signal distortion.

Another contributor to the IMD is a non-uniform design. Specifically, the more portions of different conducting materials used in a device design, the worse the device performs in terms of IMD. For example, in surface mountable devices, separate conductors are typically used to electrically connect the center conductor to contact ports of the device. Moreover, it is difficult to provide tight coplanarity in such a design because the contact ports are distinct, separate parts from the connecting conductors. Such a non-uniform contact can contribute to increased IMD levels.

Another problem associated with the microwave ferrite devices is poor alignment. In more detail, typical circulators/isolators include a number of layers such as ferrites, a center conductor, magnets, pole pieces, ground plates, and temperature compensators. These layers are generally referred to as a stack. During manufacturing of a ferrite device, the layers are stacked onto one another, and manually manipulated by a technician during an alignment process before the layers are fixed into place. As the ground planes are generally the widest layers, it is difficult to properly align the narrower layers, such as the ferrites and center conductor. As such, alignment error is difficult to avoid.

Generally stated, the overall performance of the circulator/isolator device is a function of alignment. In addition, the shaping of the center conductor can be such that a low IMD level is achieved. The center conductor is usually shaped to match the circulator's impedance to that of a transmission line. Such impedance matching enables efficient transfer of energy between the device ports. The tuning elements typically include quarter-wave transformer arms and open-end tuning stub resonators symmetrically situated between the arms. With proper alignment, the open-end tuning stub resonators can fully extend to the perimeter of its surrounding layers, thereby enabling further improvement of IMD performance.

One common alignment technique employs a well in a housing, where the layers of a device can be stacked. The diameter of the well is slightly larger than the widest layer to accommodate the elements of the stack during manufacturing. The sides of the well are slotted allowing a manual push-stick alignment of the circuit. However, such a technique does not effectively solve the alignment error problem. In addition, thermal stress caused by differing coefficients of thermal expansion associated with the stack layers is further exacerbated by alignment error, thereby causing further deterioration of device performance.

The lack of coplanarity gives rise to other problems as well. In particular, large-scale production of ferrite devices implicates simple mechanical designs that are compatible with automated pick-and-place assembling and mounting technology. The proper pick-and-place of a device having a non-uniform, non-coplanar mounting base is inhibited. Thus, the manufacturing process may require more complicated and/or costly placement processes. Moreover, reliable electrical contact with a host system (e.g., a mother board or chassis level card) requires that the connecting leads and mounting base of a circulator/isolator be rigid and coplanar. Typically, an overall coplanarity of the mounting base should be within a few mils.

Thus, both electrical and mechanical parameters of a circulator/isolator device should be suitable for pick-and-place processing in both the device assembly, as well as population of the device on a host system. What is needed, therefore, is a highly manufacturable and reliable circulator/isolator device that has a co-planar mounting surface and is capable of maintaining a low IMD.

SUMMARY OF THE INVENTION

One embodiment of the present invention provides a passive microwave device. The device has a stack including a center conductor that is configured with three or more aligning portions that are each adapted to couple with a corresponding alignment pin of an assembly fixture. The stack may further include, for example, at least one of a ground plane, a magnet, a ferrite, a pole piece, and a temperature compensator, where each stack element has one of at least three alignment holes configured to receive the alignment pins of the assembly fixture, or a shape that allows minimal play when the element is placed the between alignment pins of the assembly fixture. In one particular case, the stack includes a ferrite element on at least one side of the center conductor, where the center conductor further includes one or more tuning stub resonators, each extended to an edge of the one or more ferrite elements in a radial direction. The device may further include a locking cover that is disposed on top of the stack.

The device may further include a printed circuit board having at least three aligning holes that are configured to receive alignment pins of an assembly fixture, and a housing coupled to the printed circuit board. The housing includes a bottom portion having three or more centering slots, each centering slot corresponding to one of the aligning holes of the printed circuit board. The housing can be made, for example, from a single piece of sheet metal. In one particular case, the bottom portion of the housing further includes a number of relief openings, where each relief opening coincides with a respective conductive port location on the printed circuit board.

In another particular case, the printed circuit board has a stack side and a host side, and further includes a plurality of metallized via holes that electrically and thermally couple the stack side to the host side. The printed circuit board may also be configured with one or more host side conductive ports that are substantially coplanar with a host side ground portion.

The center conductor may include a plurality of tuning stub resonators, and each aligning portion is disposed on an end of a respective tuning stub resonator. The center conductor can be adapted for electrically and mechanically connecting to at least one conductive port on a printed circuit board. The center conductor may include tuning stub resonators and transformer arms in symmetrical relation to one another, with each tuning stub resonator being extended toward its neighboring transformer arms in an azimuthal direction.

Another embodiment of the present invention provides a method for manufacturing a circulator/isolator device. The method includes placing elements of a stack into an assembly fixture, the elements including a center conductor that is configured with three or more aligning portions that are each adapted to couple with a corresponding alignment pin of the assembly fixture. Elements of the stack may further include at least one of a ground plane, a magnet, a ferrite, a pole piece, and a temperature compensator, where each element has one of at least three alignment holes configured to receive the alignment pins of the assembly fixture, or a shape that allows minimal play when the element is placed between the alignment pins of the assembly fixture. One the stack is assembled, the method may proceed with securing the stack elements in place. In one particular case, the method includes disposing a locking cover on top of the stack, and securing the locking cover.

The method may further include placing a printed circuit board on an assembly fixture having three or more alignment pins (where the printed circuit board has at least three aligning holes that are configured to receive the alignment pins of the assembly fixture), and placing a housing on the printed circuit board. In one such case, the housing further includes a bottom portion having three or more centering slots, where each centering slot corresponds to one of the alignment pins of the assembly fixture. Note that the assembly fixtures for the printed circuit board and housing can be the same as the assembly fixture for the stack. Alternatively, the fixture can be different. For instance, if the assembly fixture in which the printed circuit board and the housing are placed is the same as the assembly fixture in which the stack is placed, then the printed circuit board and the housing are placed in the assembly fixture prior to placing the stack in the assembly fixture. On the other hand, if the assembly fixture in which the printed circuit board and the housing are placed is different than the assembly fixture in which the stack is placed, then the stack (once assembled) is placed in the assembly fixture in which the printed circuit board and the housing are placed.

In one particular case, the method continues with placing the resulting circulator/isolator device on a host system thereby contacting coplanar conductive ports and a ground portion of the printed circuit board with corresponding contacts of the host system. The method may further include electrically and mechanically connecting the center conductor to at least one conductive port on a printed circuit board. In another example, the center conductor may include a plurality of transformer arms and tuning stub resonators in symmetrical relation to one another, with each tuning stub resonator extending toward its neighboring transformer arms in the azimuthal direction, and extending to an edge of ferrite elements included in the stack.

Another embodiment of the present invention provides an assembly fixture for manufacturing a circulator/isolator device that exhibits a high degree of coplanarity on its mounting surface, and a high degree of alignment between its components. The fixture includes a base, and three or more alignment pins extending vertically from a top surface of the base. During the assembly process, the pins are adapted for at least one of coupling with corresponding holes and slots of elements included in a circulator/isolator device being assembled, and limiting radial movement of circulator/isolator device components disposed between the alignment pins. Once assembled, the circulator/isolator device can be removed from the pins of the fixture. In one such embodiment, the length of the pins is slightly less than the device's height so as to allow a cover to rest on the assembly without contacting the pins. In another such embodiment, there are three alignment pins, two of which have a fixed position, and the third pin having an adjustable position.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Embodiments of the present invention enable an inexpensive, high power circulator/isolator device having efficient IMD and temperature performance. A readily manufacturable sheet metal housing and coplanar mounting surface reduce requirements for precision machining, and allow the utilization of automated pick-and-place assembling and installation techniques. In addition, alignment of device materials, such as the stack, is maintained.

Device Structure

Figures 1A, 1B:
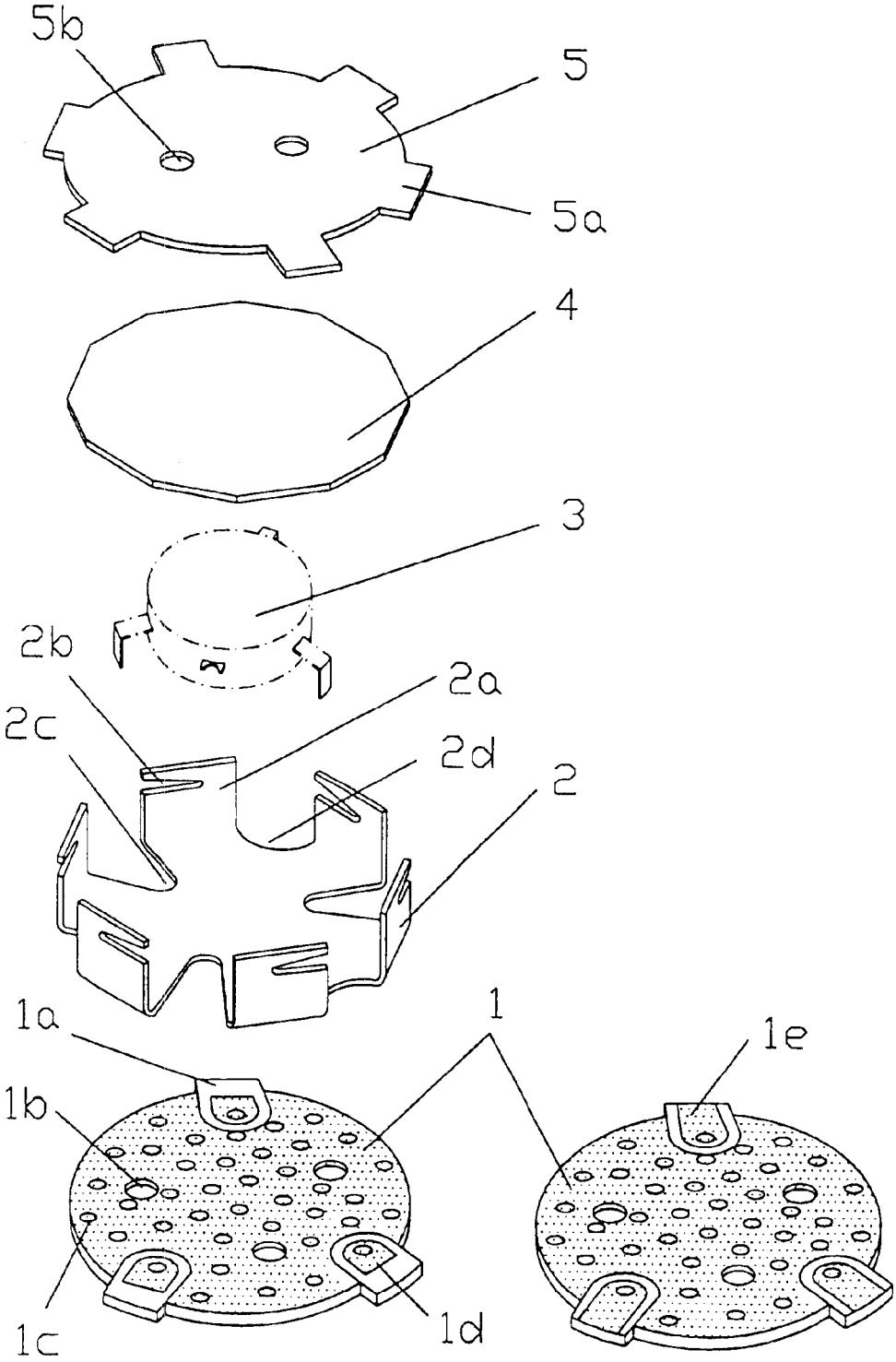
FIG. 1*a* is an exploded perspective view of the ferrite device structure configured in accordance with one embodiment of the present invention.
FIG. 1*b* illustrates the surface mount or host side of the structure illustrated in FIG. 1*a*.

FIG. 1*a* is an exploded perspective view of the circulator/isolator device structure configured in accordance with one embodiment of the present invention. The structure includes a printed circuit board (PCB) 1, a housing 2, a stack 3, a pressing cover 4, and a locking cover 5. The stack 3 is shown in its assembled state, and includes a number of components that will be discussed in reference to FIG. 2.

The PCB 1 can be a conventional printed circuit board that is masked and etched with a pattern suitable for the particular application for which the device is intended. For example, the PCB 1 can be a two side copper clad dielectric of FR-4 type material. This particular embodiment includes three conductive ports 1*a* for a circulator application, or two ports 1*a* for an isolator application. Such ports can be used for input and output of microwave energy. As port usage is the primary difference between the circulator and isolator applications, this disclosure is presented in the context of circulators so as to provide a more complete description. However, the principles of the present invention are equally applicable to isolator applications.

The PCB 1 further includes at least three aligning holes 1*b* and a plurality of the metallized via holes 1*c*. The aligning holes 1*b* are configured to receive alignment pins of an assembly fixture. The metallized via holes 1*c* electrically and thermally couple the stack side of the PCB to the host side, and operate to dissipate heat and provide a robust ground portion. The metallized surface of the PCB 1 (indicated by the dotted area) is partially removed from the ports 1*a* thereby forming short metallized pads 1*d* on the stack side of the PCB 1, as shown in FIG. 1*a*, and long metallized pads 1*e* on the host side of the PCB 1 as illustrated in FIG. 1*b*. Note how the long metallized pads 1*e* run out to the edge of the ports 1*a*. These metallized pads 1*e* allow robust, coplanar contact points that electrically and mechanically couple to contact points of a host system during a manufacturing pick-and-place operation.

PCB 1 can be, for example, drilled or stamped to form the aligning holes 1*b* and the via holes 1*c*, which can then be metallized. Conventional masking/etching processes can be used to remove unwanted metal for the surface of the PCB 1. Numerous processes can be employed to form the PCB 1, and the present invention is not intended to be limited to any one such process or type of PCB 1.

The housing 2 includes side portions 2*a* each configured with an open flare slot 2*b*, and a bottom portion configured with alternating centering slots 2*c* and relief openings 2*d*. In one embodiment, the housing 2 is made from a single piece of sheet metal (e.g., steel or aluminum). The sheet metal can be milled, stamped, or otherwise cut to a pattern so as to form the side portions 2*a*, open flare slots 2*b*, centering slots 2*c*, and relief openings 2*d*. The side portions 2*a* can then be bent up to a perpendicular position relative to the bottom portion as shown. With such an embodiment, no secondary machining of the housing 2 is required.

In the formed housing 2 of this particular embodiment, the lower horizontal portion of the flare slots 2*b* are substantially parallel to the bottom of the housing. This will allow the pressing cover 4 and teeth 5*a* of locking cover 5 to fully engage the slots 2*b*. Note that the slots 2*c*, the openings 2*d*, and the side portions 2*a* are equally spaced and symmetrically positioned relative to the central axis of the housing 2. Centering slots 2*c* have inner edges that are closest to the central axis of the housing 2. These inner edges of slots 2*c* correspond to the aligning holes 1*b*. Thus, corresponding alignment pins of an assembly fixture can be used to ensure that the centering slots 2*c* are in proper alignment with the PCB 1. In addition, each relief opening 2*d* coincides with a respective conductive port 1*a* location on the PCB 1. As such, the housing 2 will not impinge upon the location of the ports 1*a*.

The stack 3 includes a set of elements suited to the particular application. For instance, in the case of a circulator, the stack 3 could include a center conductor, two ferrite disks (one on each side of the center conductor), one or more magnets, upper and lower pole pieces, a temperature compensator, and upper and lower ground planes. Note that, depending on the application, some of the elements included in the stack 3 may be unutilized. Further note that additional elements may be employed in a particular device design depending on given specifications.

As can be seen in this embodiment, the stack 3 includes three port connectors or "transformer arms" of the center conductor extending downward. End portions of each arm electrically and mechanically connect to a respective short metallized pad 1*d* on the stack side of the PCB 1. Via holes 1*c* through each pad can be solder filled or otherwise metallized so that an electrical connection is formed at the contact point between each transformer arm and the corresponding short metallized pad 1*d*. Electrical contact is also made between each transformer arm and a respective long metallized pad 1*e* by way of one or more via holes 1*c* associated with each port 1*a*. In addition, the stack 3 center conductor includes a number of aligning portions (only one shown in FIG. 1*a*) disposed on its periphery. Each aligning portion has a half-moon or concave surface that is adapted to couple with a corresponding alignment pin of an assembly fixture. Specific embodiments of the stack 3 and its center conductor will be discussed in reference to FIGS. 2 and 4, respectively.

During device assembly, the pressing cover 4 is disposed on the top of the stack. The pressing cover 4 may be made from the same material as the housing 2, but need not be. In one embodiment, the cover 4 is a polygonal flat layer of sheet metal having as many sides as the housing 2. The cover 4 is configured to tightly fit into the inner perimeter of the housing 2, and more particularly, to engage the housing 2 slightly above the lower horizontal portion of the flare slots 2*b*. It will be appreciated that the actual shape of the housing 2 and cover 4 can vary, and that the present invention is not intended to be limited to any one shape.

A locking cover 5 is disposed on top of the pressing cover 4, and is configured with teeth 5*a*. In this particular embodiment, these teeth 5*a* are equally spaced on the periphery of the cover 5. The slots 2*b* in the housing 2 accept the teeth 5*a*. Just as with the cover 4, the locking cover 5 may be made from the same material as the housing 2. The stack 3 and the cover 4 are securely fastened in the housing 2 when the cover 5 is turned, thereby locking the stack 3 in place. There are two holes 5*b* in the locking cover 5 to receive tips of a rotation tool. After rotating the locking cover 5 into position, a bonding material (e.g., solder or glue) can be applied to the holes 5*b* so as to secure locking cover 5 to cover 4.

Stack Configuration

Figure 2:
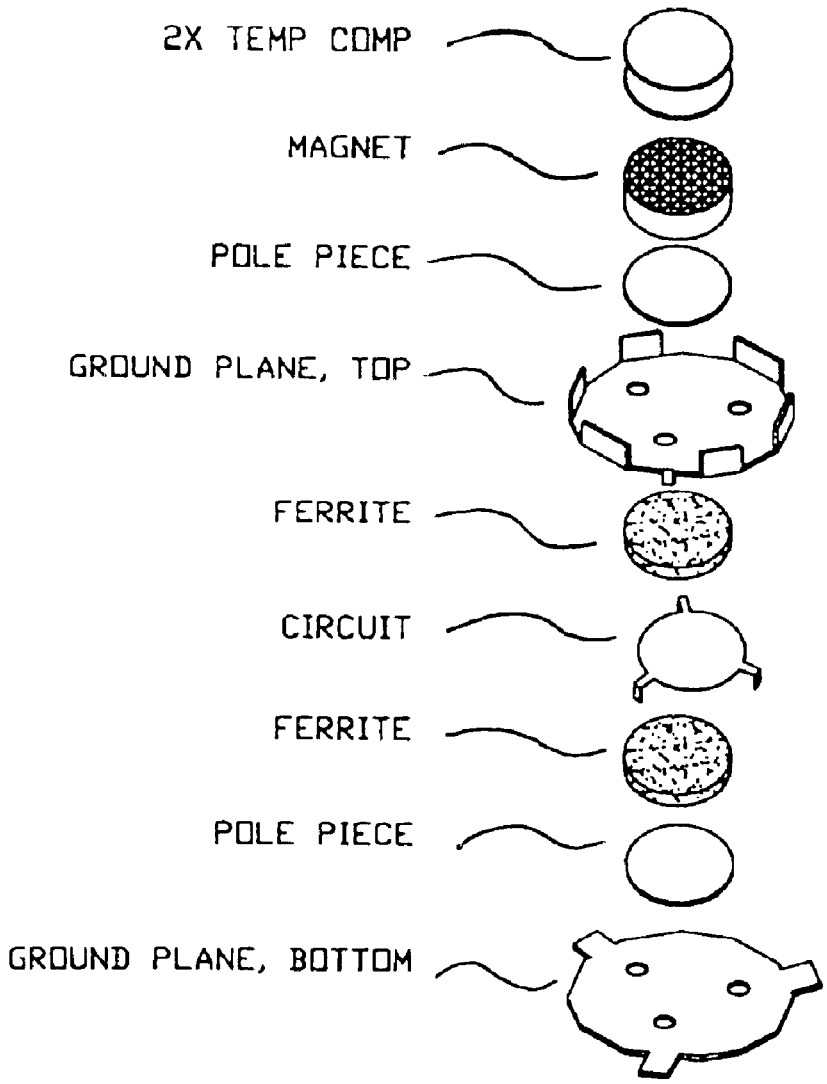
FIG. 2 illustrates the stack of a circulator/isolator device configured in accordance with one embodiment of the present invention.

FIG. 2 illustrates the stack of a circulator/isolator device configured in accordance with one embodiment of the present invention. In this example, the stack includes (from bottom up) a bottom ground plane, a lower pole piece, a lower ferrite disk, a center conductor (also referred to as a circuit herein), an upper ferrite disk, a top ground plane, an upper pole piece, a magnet, and temperature compensators.

Additional layers may be included, such as magnets, ground planes, and pole pieces, depending on the application.

The lower and upper pole pieces can be steel or some other ferromagnetic material. The circuit is typically copper, but can be any suitable conductor depending on the application. Note that the pole pieces, ferrites, magnet, and temperature compensator have substantially the same shape in this embodiment. This common shape allows minimal play when such stack elements are placed between the alignment pins of an assembly fixture. Further note that each of the three transformer arms of the circuit extend beyond the perimeter of the bottom ground plane so that they can be connected to respective short pads 1*d* of the PCB 1. Further note that the aligning portions of the circuit (not shown in FIG. 2) correspond to alignment pins of the assembly fixture such that the circuit effectively has substantially the same size as that of the pole pieces, ferrites, and magnet.

The top and bottom ground planes of this example are each configured with three alignment holes adapted to receive the alignment pins of an assembly fixture. This allows the stack to be pre-assembled in a self-aligning fashion in accordance with the principles of the present invention. Further note that the ground planes are the widest elements in the stack, and fully cover the ferrite elements. These ground planes may be, for example, silver plated copper, or other non-ferrous material depending on the desired electrical properties. Inter-laced fingers on the perimeters of the ground planes can be bent in to secure the layers of the stack, thereby forming a final stack assembly as illustrated in FIG. 1*a*.

A secondary assembly procedure utilizing similar self-alignment principles of the present invention can then be used to assemble the pre-fabricated stack into a circulator/isolator device as shown in FIG. 1*a*. Note that the secondary assembly procedure employs an assembly fixture having alignment pins that are farther apart than the alignment pins of the fixture used to assemble the stack. This will allow the pre-fabricated stack to properly fit within the pins of the assembly fixture of the secondary procedure.

In alternative embodiments, a single assembly procedure is employed, where the stack layers are assembled as part of the overall device assembly. In such an embodiment, the inter-laced fingers on the perimeters of the ground planes can be eliminated so that no bending need be performed. In another embodiment, the ground planes of the stack can be of the same shape as the other stack layers (e.g., pole pieces and ferrites) so that they fit within the aligning pins of the assembly fixture. In such cases where the interlaced fingers are not included on the ground planes, the stack layers are effectively secured in place once the locking cover 5 is installed.

Other stack configurations are possible, and the present invention is not intended to be limited to any one such configuration. Rather, any number of stack configurations can be implemented in accordance with the principles of the present invention so as to provide a self-aligning assembly process. For example, another embodiment of the present invention may employ an assembly fixture having twelve alignment pins, with two pins for bracing each side of a hexagonal shaped stack. In such a case, the stack layers would have a common shape so as to fit within the alignment pins of the fixture. Alternatively, the ground planes of the stack could be configured with twelve alignment holes that correspond to the fixture's alignment pins. In any case, a self-aligning assembly process is enabled. In this sense, the alignment of the device layers and componentry is inherent in the design.

The effective diameter of the stack, whether pre-fabricated or not, should correspond to the diameter of the circle that is tangential to the inner edges of the centering slots 2*c* of housing 2. Centering and alignment of stack 3 elements in the housing 2 is thereby enabled, as well as lower IMD. The stack elements are configured with alignment holes or other constructive features that facilitate alignment with the alignment pins of the assembly fixture.

30-Degree Rotation of Standing Wave Pattern Restoration

Figure 3:
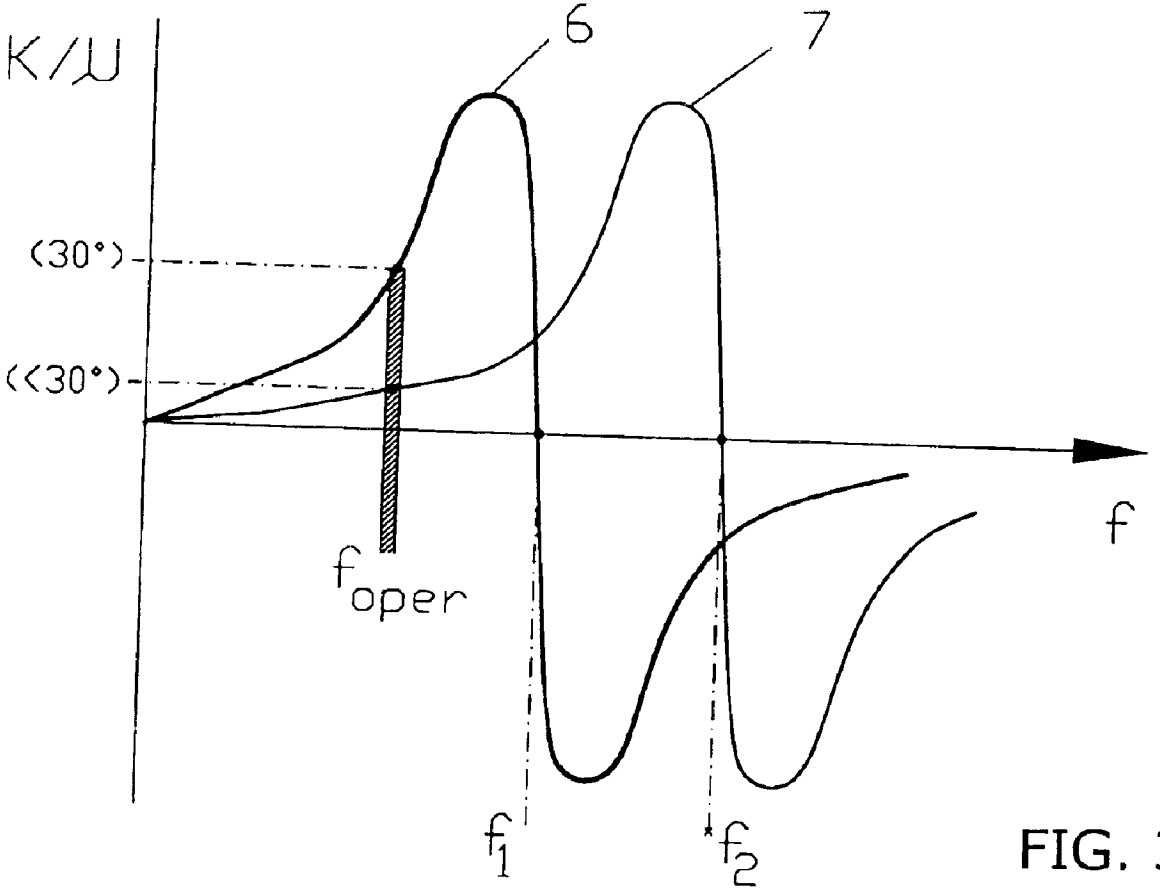
FIG. 3 graphically illustrates a function of the splitting factor versus frequency for two different values of an external magnetic field.

FIG. 3 graphically illustrates a function of the splitting factor $k/\mu$ versus frequency for two different values of an external magnetic flux. Curve 6 shows that at the operation frequency range $f_{oper}$, the splitting factor provides a 30-degree rotation of the standing wave pattern required for circulation action. The separation between the frequency of ferromagnetic resonance and the operation frequency is equal to $f_1-f_{oper}$. One way to decrease IMD is to keep this difference as large as possible. This can be achieved by increasing the external biasing magnetic field from $H_1$ to $H_2$. This will shift the curve 6 into a new position 7, thereby increasing the spacing to $f_2-f_{oper}$. With this frequency shift, however, the splitting factor at a given operation frequency range $f_{oper}$ will be diminished and the required 30-degree rotation of the standing wave pattern will not be achieved. As will now be explained, embodiments of the present invention enable restoration of the 30-degree rotation at the enhanced magnetic field.

Stack Center Conductor

Figure 4:
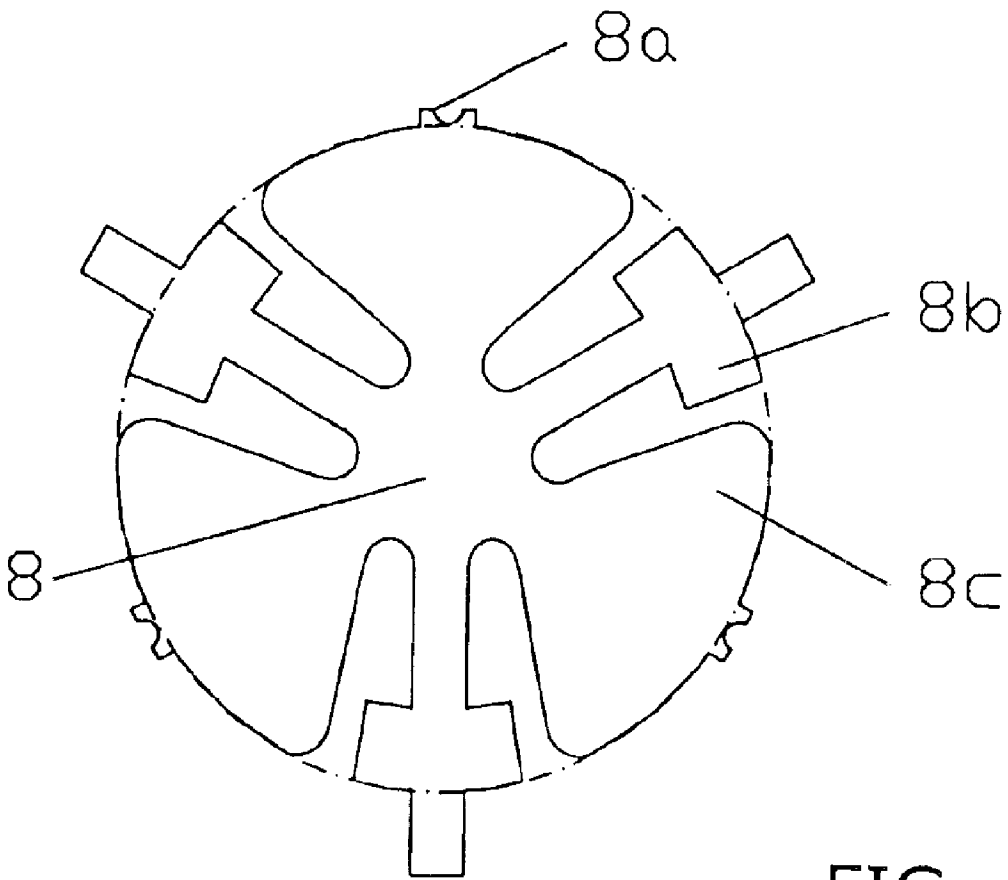
FIG. 4 illustrates a stack center conductor configured in accordance with one embodiment of the present invention.

FIG. 4 illustrates a stack center conductor configured in accordance with one embodiment of the present invention. The center conductor 8 includes three transformer arms 8*b* and three tuning stub resonators 8*c*. Each of the transformer arms 8*b* are in symmetrical relation to one another, and are substantially 120 degrees from each other. This symmetry equally applies to the tuning stub resonators 8*c*. The transformer arms 8*b* can be used for impedance matching (e.g., to a 50 ohm line). Also, an aligning portion 8*a* is disposed on the end of a respective tuning stub resonator 8*c*. Each aligning portion 8*a* has a concave surface that substantially corresponds with a respective inner edge 2*c* of the housing 2, as well as the alignment pins of an assembly fixture.

Such a self-aligning center conductor design enables the tuning stubs 8*c* to be fully extended to the perimeter of the stack. By enabling the extension of the tuning stub resonators 8*c*, the 30-degree rotation at the enhanced magnetic field can be restored. More specifically, the lowest IMD, corresponding to the highest frequency offset, can be achieved with a center conductor 8 having its tuning stub resonators 8*c* maximally extended toward the neighboring transformer arms 8*b* in the azimuthal direction, and extended to the edge of the ferrite elements in the radial direction. With such a configuration, the 30-degree rotation of the standing wave pattern corresponding to the largest allowed frequency offset can be maintained. Increased magnetic field and reduced IMD are also provided.

Note the actual shape and size of the center conductor, including its transformer arms 8*b* and tuning stub resonators 8*c*, depends on factors such as the desired frequency of operation and the desired level of IMD suppression. For instance, the narrower the tuning stub resonators 8*c*, the higher the frequency of operation. Numerous other center conductor 8 configurations are possible in light of this disclosure, and the present invention is not intended to be limited to any one such configuration. A typical range of operating frequencies for common circulator/isolator applications is, for example, 100 MHz to 30 GHz.

Assembled Device

Figure 5:
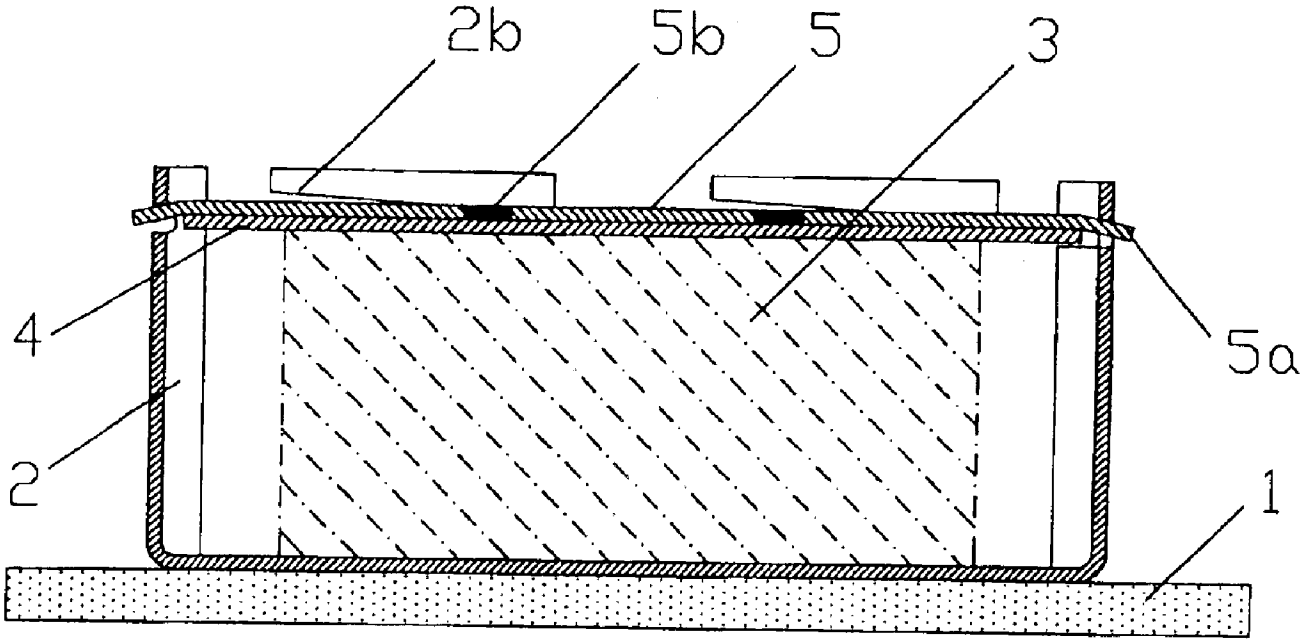
FIG. 5 illustrates a cross-sectional view of an assembled circulator/isolator device configured in accordance with one embodiment of the present invention.

FIG. 5 illustrates a cross-sectional view of an assembled circulator/isolator device configured in accordance with one embodiment of the present invention. The housing 2 can be secured to the ground portion of PCB 1 by, for example, solder or another electrically conductive bonding material. The stack 3 is disposed inside the housing 2 and is enclosed by the pressing cover 4. The locking cover 5 is disposed on a top of the cover 4, with its teeth 5*a* being received by the flare slots 2*b*. Thus, the stack 3 is held in place with a compression force resulting from turning (e.g., during the assembly process) the locking cover 5, which moves the teeth 5*a* along the slanted upper edges of the flare slots 2*b* in the housing 2. When the cover 5 is rotated into position, a drop of solder or glue can be applied throughout the holes 5*b* as previously explained.

Figure 6:
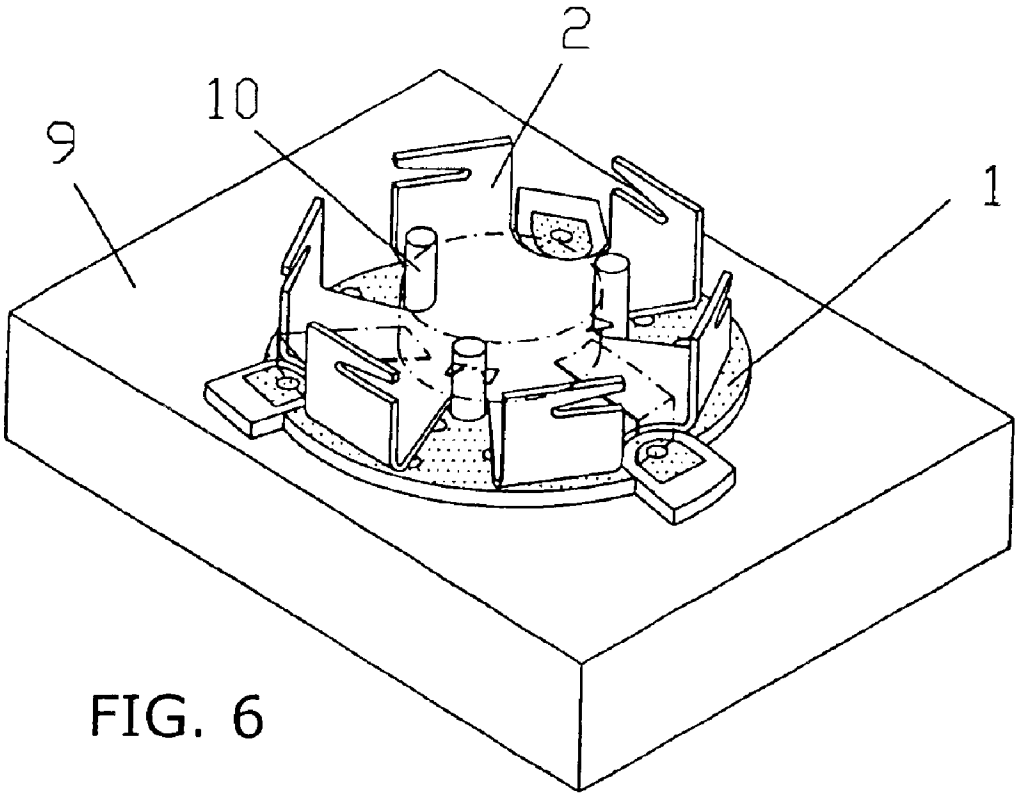
FIG. 6 illustrates a perspective view of a partially assembled circulator/isolator device that is installed in an assembly fixture in accordance with one embodiment of the present invention.

FIG. 6 illustrates a perspective view of a partially assembled circulator/isolator device that is installed in an assembly fixture in accordance with one embodiment of the present invention. This particular fixture includes a base 9 and three pins 10. Location of the pins 10 relative to each other coincides with that of the holes 1*b* in the PCB 1, slots 2*c* in the housing 2, and concave portions 8*a* of the center conductor 8. The shape of the stack elements is such that their placement between the alignment pins 10 allows minimal radial play. The length of the pins 10 on the base 9 is slightly less than the height of the stack 3. In this way, the cover 4 can rest on the stack without contacting the alignment pins 10. Thus, the locking cover 5 can be engaged when the assembly is still in the fixture and properly aligned.

In this embodiment, the end portions of the transformer arms 8*b* of the center conductor 8 are bent down and soldered to the short metallized pads 1*d* of the PCB 1, as shown on FIG. 6 with the dash-dot lines. Conductors from a host system to which the device is installed are electrically connected to the long metallized pads 1*e*. These connections are electrically continuous to the short pads 1*d* and transformer arms 8*b* by way of the metallized via holes 1*c*.

The ground portion on the host side of the PCB 1 is adapted to make contact with the ground of a host system. During the installation of the device into the host system using a pick-and-place method, the device's metallized pad 1*e* of each conductive port 1*a* and the ground portion (e.g., remaining metallized surface of the PCB host side) are simultaneously connected to their respective system contacts. Each of these electrical contacts on the device's host side are substantially coplanar with one another so as to allow such a connection. With manufacturing and assembly techniques as described herein, the coplanarity, as well as stack flatness, are substantially maintained thereby providing a high performing device.

As will be appreciated, other benefits are also realized by employing the principles of the present invention. For instance, in operation, a temperature variation of the device takes place, particularly in high power applications. The difference in coefficients of thermal extension between the stack 3 and housing 2 is compensated for by the spring action of the teeth 5*a* within a proportional segment of the stress-strain curve. The resistance of the cover 5 to bending in areas other than the teeth 5*a* is much greater. Therefore, during those variations the portion of cover 5 that contacts the stack 3 remains substantially flat and continues to provide relatively uniform and unchanging pressure on the stack 3. Thus, a stable performance of the device, including a low IMD if desired, is preserved over a broad range of temperatures.

Alignment Fixture

Figure 7A:
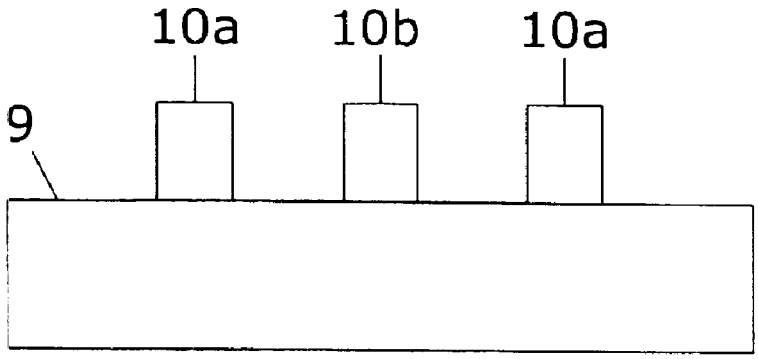
FIGS. 7*a* and 7*b* illustrate side and top views respectively of an assembly fixture configured in accordance with one embodiment of the present invention.
Figure 7B:
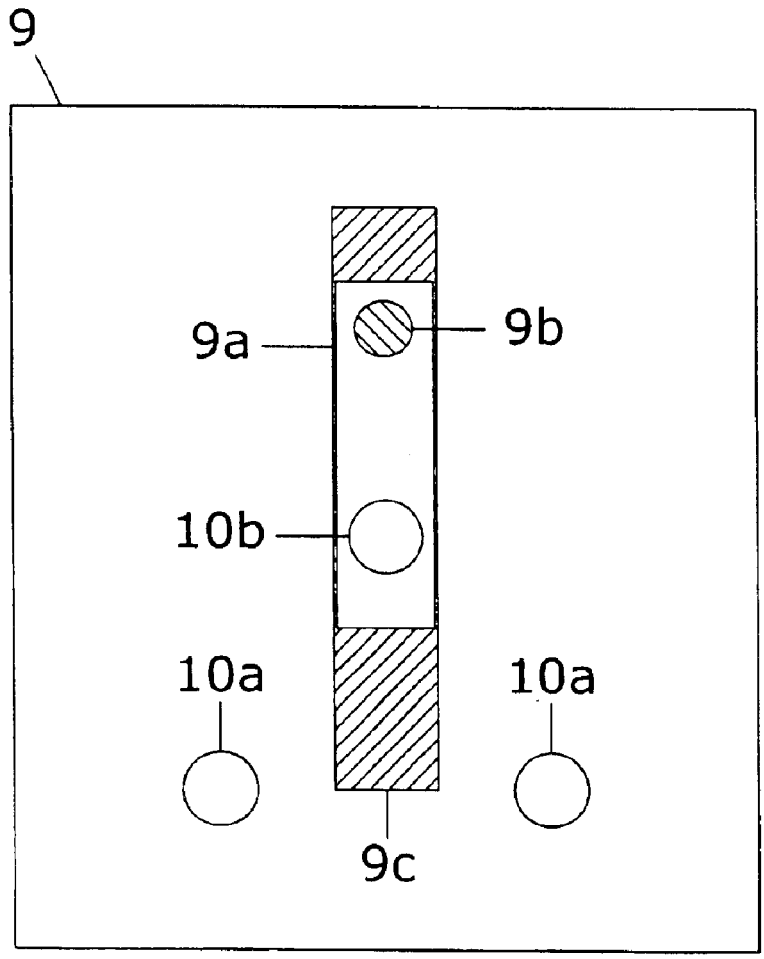

FIGS. 7*a* and 7*b* illustrate side and top views respectively of an assembly fixture configured in accordance with one embodiment of the present invention. As can be seen, the fixture of this embodiment includes a base 9 and three alignment pins 10 extending vertically from the upper surface of the base 9. The position for each of pins 10*a* is fixed in the base 9, while the position of pin 10*b* is adjustable. In particular, pin 10*b* is positioned on a slider 9*a*, which is adapted to slide in a groove 9*c* formed in the surface of base 9. The adjustable nature of pin 10*b* allows for some flexibility when assembling a circulator/isolator device or stack to reduce radial play. Once pin 1*b* is in the desired position, a thumb screw 9*b* (or other suitable retaining mechanism) can be tightened to secure pin 10*b* in position.

Other fixture configurations will be apparent in light of this disclosure, and the present invention is not intended to be limited to any one such configuration. Rather, any fixture having three or more alignment pins that can be employed to automatically align the layers of a circulator/isolator device or stack during the assembly process can be configured in accordance with the principles of the present invention. The size of the base 9, as well as the spacing between the pins 10, can vary depending on the size of the device being manufactured.

The foregoing description of the embodiments of the invention has been presented for the purposes of illustration and description. It is not intended to be exhaustive or to limit the invention to the precise form disclosed. Many modifications and variations are possible in light of this disclosure. For example, the principles of the present invention can be employed in the assembly of any device that requires alignment of its layers, and need not be limited to circulator/isolator devices. It is intended that the scope of the invention be limited not by this detailed description, but rather by the claims appended hereto.

What is claimed is:

1. A passive microwave device, comprising:

a stack including a center conductor that is configured with three or more aligning portions that are each adapted to couple with a corresponding alignment pin of an assembly fixture.

2. The device of claim 1 wherein the center conductor further includes a plurality of tuning stub resonators, and each aligning portion is disposed on an end of a respective tuning stub resonator.

3. The device of claim 1 wherein the center conductor is adapted for electrically and mechanically connecting to at least one conductive port on a printed circuit board.

4. The device of claim 1 wherein the stack further includes at least one of a ground plane, a magnet, a ferrite, a pole piece, and a temperature compensator, with each stack element having one of at least three alignment holes configured to receive the alignment pins of the assembly fixture, or a shape that allows minimal play when the element is placed between the alignment pins of the assembly fixture.

5. The device of claim 1 wherein the stack further includes a ferrite element on at least one side of the center conductor, the center conductor further including one or more tuning stub resonators, each extended to an edge of the one or more ferrite elements in a radial direction.

6. The device of claim 1 wherein the center conductor further includes tuning stub resonators and transformer arms in symmetrical relation to one another, with each tuning stub resonator extended toward its neighboring transformer arms in an azimuthal direction.

7. The device of claim 1 further comprising:

a printed circuit board having at least three aligning holes that are configured to receive alignment pins of an assembly fixture; and a housing coupled to the printed circuit board, and including a bottom portion having three or more centering slots, each centering slot corresponding to one of the aligning holes of the printed circuit board.

8. The device of claim 7 further comprising: a locking cover disposed on top of the stack.

9. The device of claim 7 wherein the bottom portion of the housing further includes a number of relief openings, each relief opening coinciding with a respective conductive port location on the printed circuit board.

10. The device of claim 7 wherein the housing is made from a single piece of sheet metal.

11. The device of claim 7 wherein the printed circuit board has a stack side and a host side, and further includes a plurality of metallized via holes that electrically and thermally couple the stack side to the host side.

12. The device of claim 7 wherein the printed circuit board has a stack side and a host side, and one or more host side conductive ports are substantially coplanar with a host side ground portion.

13. An assembly fixture for manufacturing a circulator/isolator device that exhibits a high degree of coplanarity on its mounting surface, and a high degree of alignment between its components, the fixture comprising:

a base; and three or more alignment pins extending vertically from a top surface of the base, wherein during the assembly process, the pins are adapted for at least one of:

coupling with corresponding holes and slots of elements included in a circulator/isolator device being assembled; and limiting radial movement of circulator/isolator device components disposed between the alignment pins;

wherein once assembled, the circulator/isolator device can be removed from the pins of the fixture.

14. The fixture of claim 13 wherein the length of the pins is slightly less than the device's height so as to allow a cover to rest on the assembly without contacting the pans.

15. The fixture of claim 13 wherein there are three alignment pins, two of which have a fixed position, and the third pin having an adjustable position.

16. A method for manufacturing a circulator/isolator device, the method comprising:

placing elements of a stack into an assembly fixture, the elements including a center conductor that is configured with three or mare aligning portions that are each adapted to couple with a corresponding alignment pin of the assembly fixture.

17. The method of claim 16 further comprising:

electrically and mechanically connecting the center conductor to at least one conductive port on a printed circuit board.

18. The method of claim 16 further comprising:

disposing a locking cover on top of the stack; and securing the locking cover.

19. The method of claim 16 wherein the center conductor further includes a plurality of transformer arms and tuning stub resonators in symmetrical relation to one another, with each tuning stub resonator extending toward its neighboring transformer arms in the azimuthal direction, and extending to an edge of ferrite elements included in the stack.

20. The method of claim 16 wherein elements of the stack further include at least one of a ground plane, a magnet, a ferrite, a pole piece, and a temperature compensator, with each element having one of at least three alignment holes configured to receive the alignment pins of the assembly fixture, or a shape that allows minimal play when the element is placed between the alignment pins of the assembly fixture.

21. The method of claim 16 further comprising: securing the stack elements in place.

22. The method of claim 16 further comprising:

placing a printed circuit board on an assembly fixture having three or more alignment pins, the printed circuit board having at least three aligning holes that are configured to receive the alignment pins of the assembly fixture; and placing a housing on the printed circuit board, the housing including a bottom portion having three or more centering slots, each centering slot corresponding to one of the alignment pins of the assembly fixture.

23. The method of claim 22 wherein the assembly fixture in which the printed circuit board and the housing are placed is the same as the assembly fixture in which the stack is placed, and the printed circuit board and the housing are placed in the assembly fixture prior to placing the stack in the assembly fixture.

24. The method of claim 22 wherein the assembly fixture in which the printed circuit board and the housing are placed is different than the assembly fixture in which the stack is placed, and once assembled, the stack is placed in the assembly fixture in which the printed circuit board and the housing are placed.

25. The method of claim 22 wherein the method produces a circulator/isolator device, the method further comprising:

placing the circulator/isolator device on a host system thereby contacting coplanar conductive ports and a ground portion of the printed circuit board with corresponding contacts of the host system.

* * * * *